United States Patent [19]

Faux, Sr. et al.

[11] 4,056,718

[45] Nov. 1, 1977

[54] HEAVY DUTY FLOODLIGHT FIXTURE

[75] Inventors: Kenneth R. Faux, Sr., Mequon; William A. Wenman, both of Milwaukee, Wis.

[73] Assignee: Phoenix Products Company, Inc., Milwaukee, Wis.

[21] Appl. No.: 664,914

[22] Filed: Mar. 8, 1976

[51] Int. Cl.[2] ..... F21M 3/00

[52] U.S. Cl. ..... 362/306

[58] Field of Search ..... 240/61.11, 9, 3, 41.35 E, 240/41.15, 90

[56] References Cited

U.S. PATENT DOCUMENTS

| | | | |
|---|---|---|---|
| 3,001,060 | 9/1961 | Moore | 240/3 |
| 3,018,365 | 1/1962 | Wenman | 240/90 |
| 3,127,117 | 3/1964 | Mappes | 240/90 |
| 3,459,934 | 8/1969 | Moore | 240/3 |
| 3,529,149 | 9/1970 | Dwyer | 240/90 |
| 3,610,915 | 10/1971 | Moore | 240/3 |

*Primary Examiner*—Monroe H. Hayes
*Attorney, Agent, or Firm*—Ira Milton Jones & Associates

[57] ABSTRACT

A wide beam floodlight fixture by which the light from a lamp bulb that radiates light in all directions away from its axis, directs that light in a wide well defined beam. The fixture comprises a housing with a transparent front wall, and opposite opaque top, bottom and side walls. A curved reflector in the rear of the fixture housing embraces the lamp bulb and directs its light out of the transparent front wall. The top and bottom walls of the fixture have aligned access ports through either of which the lamp bulb may be removed and replaced. A socket housing removably attached to the bottom wall of the fixture housing closes the bottom access port and has the socket for the lamp bulb base shock-resistantly mounted therein. The access port in the top wall of the fixture housing is closed by a removable cover, from the underside of which a flanged ring is resiliently supported to embrace the upper end portion of the lamp bulb.

1 Claim, 5 Drawing Figures

23
17
12
20
19
35
22
32
6
34
37
33
25
31
48
44
46
52
5'
51
36
42'
26
24
50
11
9
10
55
21
17
20
5
23

HEAVY DUTY FLOODLIGHT FIXTURE

This invention relates generally to industrial lighting fixtures and more particularly to a heavy duty floodlight by which the light from a high intensity axially symmetrical lamp bulb is projected onto any selected area.

The type of lamp bulb for which the lighting fixture of this invention is intended radiates light in all directions away from its axis. For efficient utilization of its intense light, the lamp bulb is installed in a fixture that includes a reflector positioned to direct the light out of the front of the fixture in a well defined wide beam. By adjusting the orientation of the fixture on its supporting structure, the beam can be directed onto any selected area.

Obviously, of course, the lamp bulb must be replaceable, but since these floodlights are often mounted in difficult to reach locations, as for instance the outer end of the boom of a crane, it is important that the fixture be adapted for quick and easy removal and replacement of the bulb. It is also important that the mounting of the lamp bulb in the fixture will always hold the bulb in a predetermined relationship to the reflector, but in a manner that fairly well insulates the lamp from the vibration and mechanical shocks to which the fixture is subjected by the rough environment of its typical installation.

With these considerations in mind, it is a general object of this invention to provide a heavy duty floodlight fixture well adapted for use in locations that are subject to vibration and mechanical shocks, and in which a shock resistant mounting holds a high intensity axially symmetrical lamp bulb in substantially fixed relation to a reflector in the fixture, in a manner that allows the lamp to have limited yielding movement relative to the fixture.

Another object of the invention is to provide a heavy duty floodlight fixture of the character described with coaxial lamp supports by which the lamp bulb is held at both its ends, in a manner allowing the lamp to have limited freedom for yielding shock resistant motion relative to the fixture.

A further amd more specific object of the invention is to provide a heavy duty floodlight fixture which achieves the aforesaid objectives and which, in addition, is characterized by exceptionally convenient provision for removing and replacing the lamp bulb, either upwardly through the top or downwardly through the bottom of the fixture, so that the orientation of the fixture with respect to the structure on which it is mounted need not be disturbed when lamp replacement is needed.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which.

Figure 4:
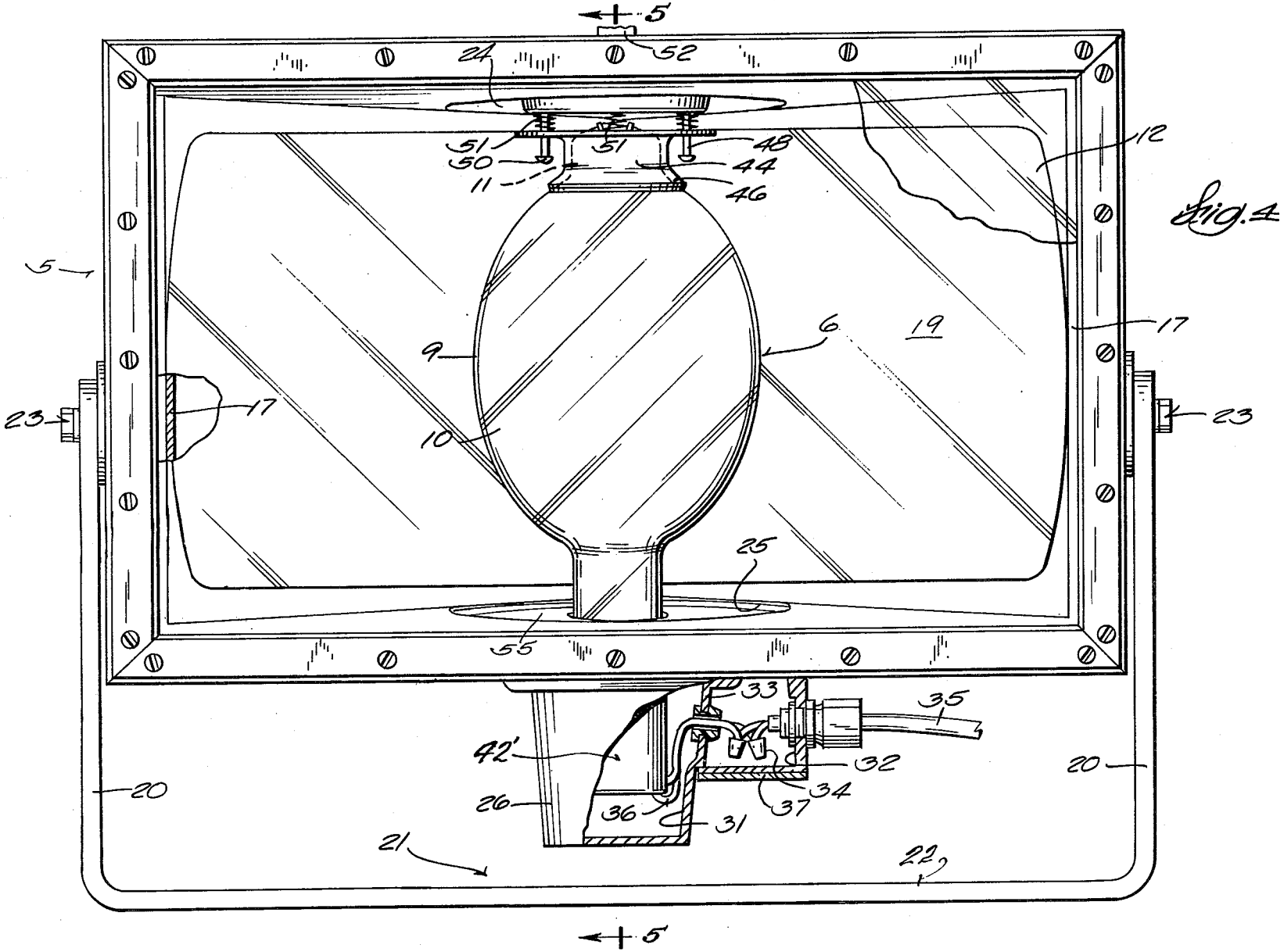
FIG. 4 is a front view of the fixture with portions broken away to illustrate details.
Figure 5:
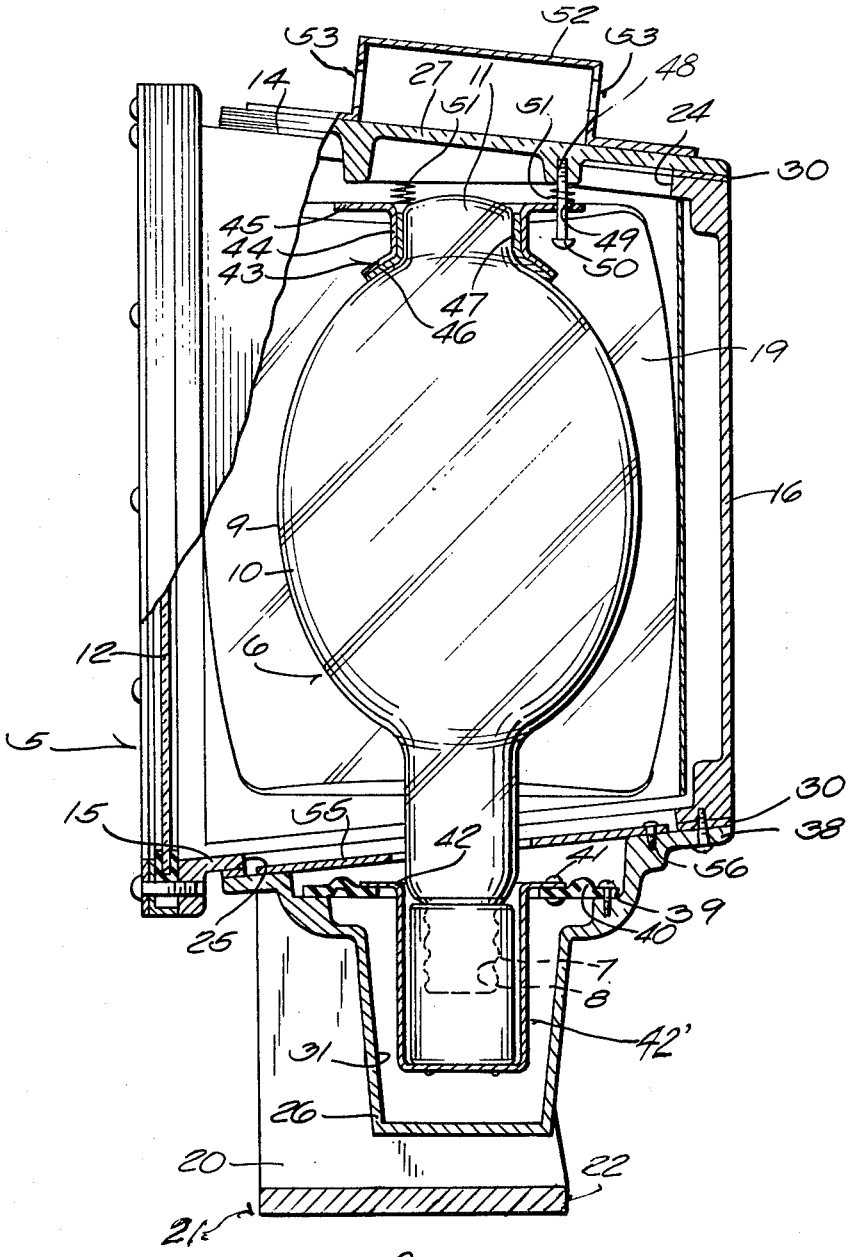
FIG. 5 is a vertical sectional view through the fixture, taken on the plane of the line 5—5 in FIG. 4.

Referring now to the accompanying drawings, the numeral 5 designates generally a heavy duty flood light fixture embodying the principles of the invention, and adapted to have an axially symmetrical lamp bulb 6 mounted therein. The lamp bulb, which is typicaly rated at 1,000 watts, may be of the mercury vapor, metal halide or high pressure sodium variety. Each of these lamps has a screw threaded base 7 by which the lamp is secured in a mating socket 8, and a glass envelope 9 which, in the case of the high pressure sodium lamp, has a uniform diameter for its entire length. The envelope of the other two types — as shown in FIGS. 4 and 5 — has a large diameter generally egg-shaped medial portion 10 and a smaller diameter cylindrical and coaxial protuberance 11 on its end remote from the base.

The fixture 5 comprises housing structure having the general shape of a rectangular pan with a transparent front wall 12 across its open side. The transparent front wall is oriented with its shorter dimension extending more or less vertically and its longer dimension extending generally horizontally. Assuming such normal orientation, the housing further comprises structure defining rigid, opposite top and bottom walls 14 and 15, respectively, both substantially perpendicular to the transparent front wall, a rear wall 16 and upright side walls 17 which diverge angularly from the rear wall to the side edges of the front wall and connect the top and bottom walls. The lamp bulb 6 is situated in the housing symmetrically between its side walls, with its axis upright and thus substantially parallel to the transparent front wall and in intersecting relation to the top and bottom walls.

A curved reflector 19 is mounted in the rear of the housing with its medial portion close to the rear wall and its opposite ends near the junctions of the transparent front wall with the side walls. The reflector curves around the lamp bulb to reflect the light emanating therefrom outwardly through the transparent front wall in a well defined wide beam which may be directed onto any selected area by appropriately orienting the fixture on the structure to which it is secured.

To mount the fixture where desired, its housing is embraced between and connected to the legs 20 of a U-shaped mounting bracket 21, the base 22 of which is securable to the machine part or other structure upon which the fixture is to be mounted in a manner allowing for some adjustment of the mounting bracket about a vertical axis. To provide for tilting adjustment of the fixture housing about a horizontal axis parallel to its transparent front wall, coaxial lockable swivel connections 23 secure its side walls to the upper end of the legs 20 of the mounting bracket.

Figure 1:
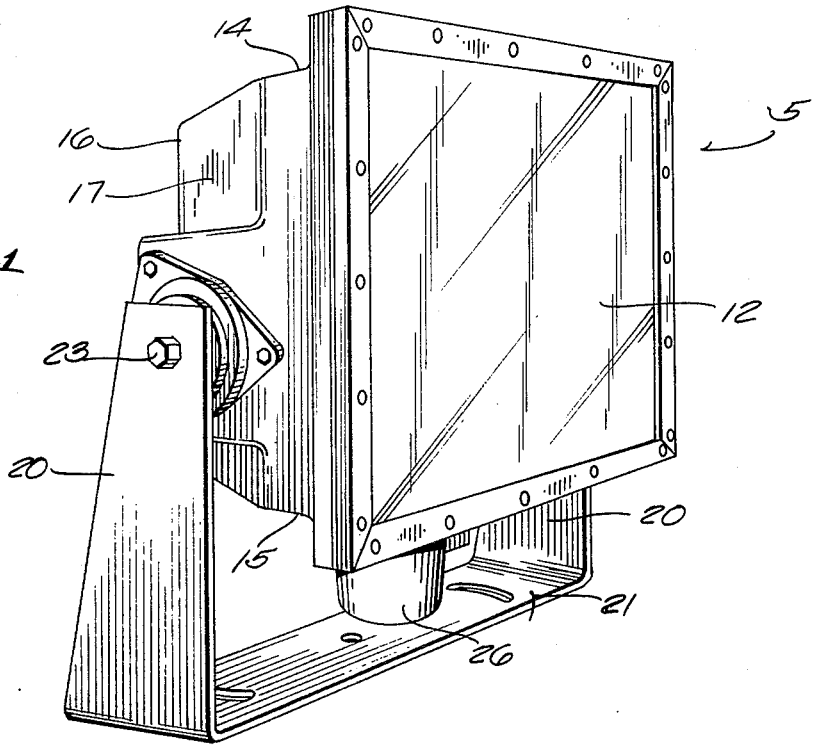
FIG. 1 is a perspective view of a floodlight fixture embodying the principles of this invention, viewing the same from the front.
Figure 2:
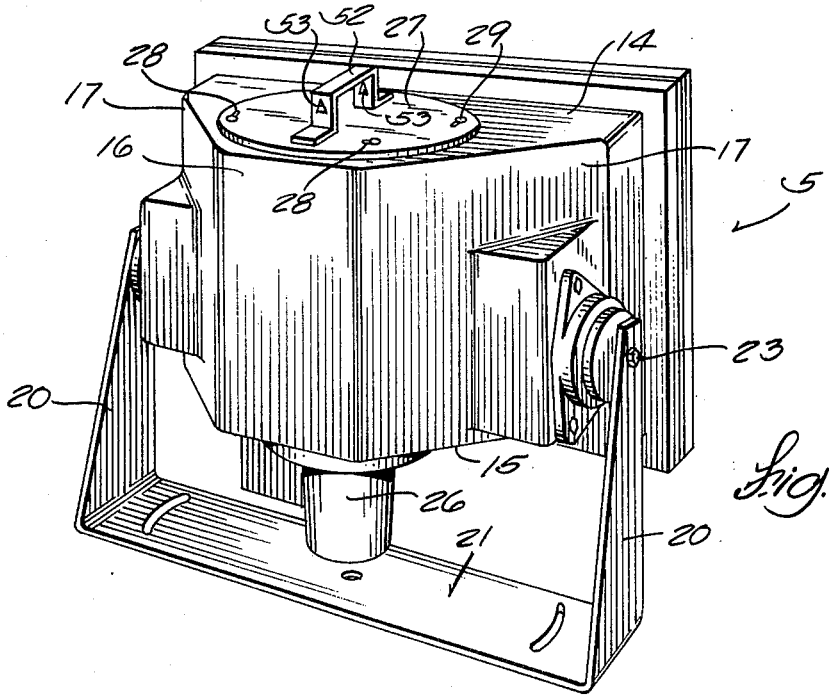
FIG. 2 is a perspective view of the fixture viewing the same from the rear.
Figure 3:
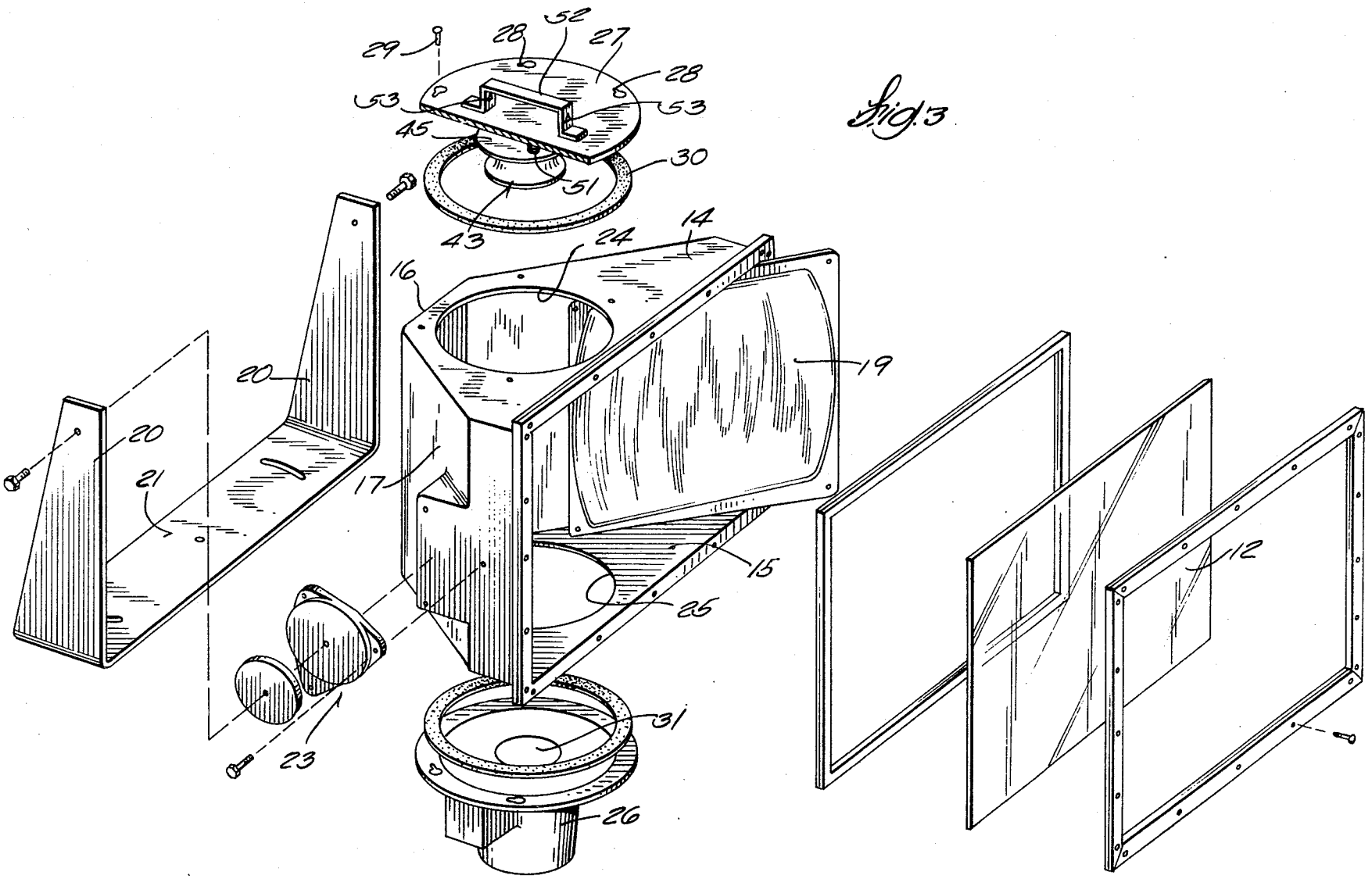
FIG. 3 is an exploded perspective view of the main parts of the fixture.

As best seen in FIG. 3, the top and bottom walls of the housing have coaxial round holes 24 and 25, respectively. These holes provide access ports into the interior of the housing and enable the lamp bulb to be inserted and removed either upwardly through the hole or port 24 or downwardly through the port 25.

A closure member in the form of socket housing 26 detachably connected to the bottom wall 15 of the housing closes the port 25 and the port 24 is closed by a cover or lid 27. In each instance the closure member is removably connected to its respective housing wall by the interengagement of circumferentially spaced keyhole slots 28 in the peripheral portion of the closure member with screws 29 threaded into the adjacent housing wall and also, in each case, a gasket 30 clamped between the closure member and the housing wall assures a weathertight joint.

A socket housing 26 is shaped to provide an upwardly opening central main cavity 31 in which the lamp socket 8 is located and a laterally adjacent smaller cavity which is separated from the main cavity by a partition wall 33. The cavity 32 serves as a junction or splice box for the electrical connections 34 between the supply line 35 and the leads 36 from the terminals of the socket. Access into the cavity 32 from the exterior of the fixture is through its open bottom which is closed by a removable cover 37.

The upper portion of the socket housing 26 forms a flange 38 that encircles the open top of its central cavity 31 and has a planar top surface to clamp the adjacent gasket 30 against the flat bottom wall of the fixture housing when the screws 29 are tightened. Spaced downward a short distance from the flange 38 the side wall of the socket housing has a ledge 39, and seated on and secured to this ledge by circumferentially spaced screws in an annular diaphragm 40 of rubber or the like. The inner edge of this diaphragm is secured, as by means of rivets 41, to a flange 42 that encircles and projects radially from the mouth of a cylindrical metal cup 42' to the bottom of which the lamp socket is secured. The cup 42' serves as a substantialy rigid carrier for the lamp socket, and by virture of the securement of its flange 42 to the inner edge of the rubber diaphragm 40, the latter provides a resilient shock absorbing mount for the lamp socket.

Attention is directed to the fact that the manner in which the lamp socket is mounted not only resiliently isolates the socket — and hence the lamp — from the effects of shock and vibration to which the fixture is subjected, but also has the virture of enabling the height of the housing to be held to a dimension only slightly greater than the height of the envelope of the lamp. This desirable compactness results from the fact that the entire lamp socket assembly, which includes the carrier 42', is located within the cavity 31, to which it is confined by the securement of the peripheral portion of the rubber diaphragm 40 to the ledge 39 at the mouth of the cavity.

It will be apparent that if the lamp bulb were supported only by its base, the yieldability of the shock mounting of the socket 8, combined with the leverage of the rather large envelope 9 could result in relatively large excursions of the lamp bulb from its intended position in response to mechanical shocks and vibrations imparted to the fixture. To prevent that objectionable consequence, the lamp bulb is steadied at its upper end in a manner which allows it to have limited yielding movement relative to the housing without subjecting its relatively fragile glass envelope to the danger of breakage even though the envelope becomes highly heated when the lamp is burning and the steadying means engages it firmly.

The means for thus steadying the lamp bulb comprises a flanged ring 43 which has a resilient connection with the lid or cover 27 and embraces the upper end portion of the lamp when the lid or cover is in place closing the hole or port 24. In the case of the lamp illustrated, the upper end portion thereof is its cylindrical protuberance 11.

The ring 43 can comprise a single piece of light sheet metal formed to define a cylindrical medial portion 44, a wide upper flange 45 and a frustoconical lower flange 46. The inner surface of the cylindrical medial portion and the bottom of the lower flange are preferably lined with heat insulating material 47.

The cylindrical medial portion 44 of the ring has an axial length about equal to that of the cylindrical protuberance 11 on the bulb, and with its liner 47 it has an inside diameter to fit that protuberance or the upper end portion of a uniform diameter high pressure sodium lamp, rather loosely. If the lamp is of the type illustrated, the frustoconical lower flange 46 rests on the larger diameter portion of the lamp envelope that is downwardly adjacent to its cylindrical protuberance 11, and to facilitate that engagement, the flange 46 is downwardly and outwardly flared to mate with the outwardly radiating envelope surface on which it rests.

The resilient connection between the ring 43 and the lid or cover 29 comprises a plurality of circumferentially spaced studs 48 that project downwardly from the underside of the lid or cover 27 and extend through loosely fitting holes 49 in the upper flange 45 of the ring 43. The ring 43 is thus capable of up and down motion relative to the lid or cover 27, and by virture of the loose fit of the studs 48 in the holes 49, also has some freedom to shift in radial directions. Enlarged heads 50 on the lower ends of the studs define the lower limit of downward motion of the ring relative to the lid or cover 27; and coiled expansion springs 51 that encircle the studs and react between the lid or cover 27 and the upper flange 45, yieldingly urge the ring downwardly.

When the lid or cover 27 is secured in place on the top wall 14 of the housing, and the ring 43 is engaged with the upper end portion of the lamp bulb, the springs 51 hold the frustoconical lower flange 46 of the ring firmly seated on the outwardly bulging envelope surface beneath the protuberance 11. Obviously, of course, if the lamp is of the type having a uniform diameter envelope, the springs hold the ring in its lowermost position seated on the heads 50 of the studs. In each instance, though, the springs 51 cooperate with the studs 48 to yieldingly limit radial motion of the lamp bulb, and generally cooperate with the resilient shock-cushioning mount of the lamp socket to insulate the lamp bulb from the mechanical shocks and vibrations to which the fixture is subjected.

It will be apparent that, in addition to cushioning the lamp bulb from mechanical shocks and vibrations imparted to the fixture, the springs 51 also serve to accommodate axial thermal expansion and contraction of the bulb envelope, in the case of lamps of the type illustrated, which can be rather substantial inasmuch as high intensity lamp bulbs become highly heated when in use. The springs can perform this function by reason of the frustoconical configuration of the lower flange 46 and its cooperation with the correspondingly shaped portion of the lamp bulb envelope that it engages. Furthermore, because the lower flange 46 is maintained firmly seated on the underlying portion of the lamp bulb envelope under the biasing force of the springs, the cylindrical medial portion 44 of the ring 43 can fit rather loosely around the cylindrical protuberance 11 so that there is no danger of the envelope being cracked in consequence of its engagement by the ring.

Inasmuch as the ring 43 lifts off of the lamp bulb when the lid or cover 27 is removed from the housing. and more or less automatically fits itself properly onto the lamp when the cover is installed, no invonvenience is experienced in replacing a lamp bulb through the port 25 in the top wall of the hohsing, since this opening is large enough to permit insertion of the hand.

Removal and replacement of the lamp bulb through the port 25 in the bottom wall of the fixture housing is equally easy, and in fact easier, since in this case it is not necessary to insert the hand into the fixture housing to unscrew the lamp from its socket and replace it with a new lamp.

In either case, a screw driver or the like is all that is needed to loosen the screws holding the selected port closure, i.e. the lid or cover 27 or the socket housing 26 in place. Anyone who has ever had to crawl out onto the boom of a crane to change a lamp bulb in a floodlight will appreciate the ease with which this can be done in the floodlight of this invention; but even more will he appreciate the option of being able to effect the exchange through either the top or bottom of the fixture. Because of that option, re-lamping very seldom, if ever, requires disturbing the orientation of the fixture on the structure to which it is secured. This is a significant advantage, since special tools are needed to loosen and retighten the connections 23 by which the fixture housing is secured to the mounting bracket in the desired orientation; but — even more important — reorientation of the fixture is not easily effected.

In this connection, attention is directed to the fact that the lid or cover 27 has a handle 52 fixed thereon. This handle not only facilitates removal and replacement of the lid or cover, but also provides sighting means that is useful in orienting the fixture. To this end, the legs of the U-shaped handle 52 have aligned "peep" holes 53, the axis of which bears a defined relationship to the light beam projected from the fixture.

Another advantageous feature of the fixture of this invention resides in the fact that while the cavity 32 that provides the junction or splice box is an integral part of the socket housing, the partition which separates this cavity from the cavity 31 in which the lamp socket is located protects the connections 34 of the socket leads with the supply line as well as the adjacent portions of the supply line from the high heat in the lamp socket cavity.

With a view to minimizing the transfer of the high heat of the lamp bulb to the lamp socket and its leads, a shield 55 is mounted in the bottom of the fixture housing. This shield — which is centrally apertured to accommodate the base of the lamp bulb — extends across the mouth of the socket housing and is secured to the peripheral top surface thereof by screws 56.

From the foregoing description taken with the accompanying drawings, it will be apparent that this invention provides a heavy duty floodlight fixture that is far superior to any heretofore available.

Those skilled in the art will appreciate that the invention can be embodied in forms other than as herein disclosed for purposes of illustration.

The invention is defined by the following claims:

1. A floodlight fixture of the type having a housing with a transparent front wall, rigid top and bottom walls which have aligned holes through either of which access may be had to the interior of the housing, and a reflector facing the transparent wall, a closure member detachably secured to each of said rigid top and bottom walls over the hole therein, and a lamp socket on one of said closure members to receive the base of a lamp, said fixture being characterized by an improved shock resistant mounting for its lamp comprising the combination of:

A. means on said one of the closure members forming a socket-receiving cavity which opens to the interior of the housing and has a ledge at the mouth thereof;

B. an annular diaphragm of resiliently yieldable material having its peripheral portion seated on and secured to said ledge;

C. a substantially rigid carrier embracing the lamp socket, said carrier having a closed end to which the socket is attached and an open end provided with mounting flange means;

D. means securing said mounting flange means to the inner edge portion of the annular diaphragm, with the carrier and the socket attached thereto located in said cavity and spaced from the walls thereof so as to be free to move to the extent the resiliency of the diaphragm permits such motion;

E. a ring of a size to embrace the end portion of a lamp opposite its base, said ring having 1. a cylindrical portion to encircle the protuberance at the outer end of a lamp bulb of the type having an enlarged medial portion and a protuberance projecting therefrom,
2. a first outwardly projecting flange on and encircling one end of the ring, to engage the adjacent surface of the enlarged medial portion of the lamp bulb, and
3. a second outwardly projecting flange on and encircling the other end of the ring;

F. a plurality of circumferentially spaced studs projecting inwardly from the other one of said closure members and passing loosely through holes in the second outwardly projecting flange on said ring;

G. springs encircling said studs and confined between said second outwardly projecting flange on the ring and said other closure member yieldingly urging the ring towards said annular diaphragm, so that said springs and the resilient yieldability of the diaphragm coact to floatingly hold the lamp and isolate the same from shocks to which the fixture may be subjected; and H. abutments on the studs to limit spring produced movement of the ring when such movement is not limited by the presence of a lamp.

* * * * *